US006264397B1

(12) United States Patent
Majewski

(10) Patent No.: US 6,264,397 B1
(45) Date of Patent: Jul. 24, 2001

(54) DUAL TROWEL BLADE ASSEMBLY

(76) Inventor: Charles Majewski, 233 S. Whitney St., Hartford, CT (US) 06105

( * ) Notice: Subject to any disclaimer, the term of this patent is extended or adjusted under 35 U.S.C. 154(b) by 0 days.

(21) Appl. No.: 09/470,400

(22) Filed: Dec. 28, 1999

(51) Int. Cl.[7] ..... E01C 19/22

(52) U.S. Cl. ..... 404/112; 404/114; 404/120; 451/350

(58) Field of Search ..... 404/112, 114, 404/118, 120; 15/235.4; 451/350, 351, 353

(56) References Cited

U.S. PATENT DOCUMENTS

| | | | | |
|---|---|---|---|---|
| 2,594,331 | * | 4/1952 | McCrey | 404/112 |
| 2,605,683 | * | 8/1952 | Boulton | 404/112 |
| 2,662,454 | | 12/1953 | Whiteman | 94/45 |
| 2,667,824 | * | 2/1954 | McCrey | 404/112 |
| 2,689,507 | | 12/1954 | McCreary | 94/45 |
| 3,375,766 | * | 4/1968 | Zochil | 404/112 |
| 5,759,590 | * | 6/1998 | Cacossa | 425/183 |
| 6,058,922 | * | 5/2000 | Sexton | 125/13.01 |

* cited by examiner

*Primary Examiner*—Thomas B. Will
*Assistant Examiner*—Gary S. Hartmann
(74) *Attorney, Agent, or Firm*—Ohlandt, Greeley, Ruggiero, & Perle, LLP

(57) ABSTRACT

A trowel blade assembly for use with a rotary surfacing machine with the assembly consisting of a relatively thick, inflexible trowel blade and a relatively thin, flexible finish blade, wherein the latter is secured with respect to the former such that when in operation on a substantially horizontal working surface, with the blade assembly selectively rotated about a horizontal axis, the finish blade is continuously in contact with the working surface regardless of the consequent variable degrees of tilting of the trowel blade with respect to the working surface.

10 Claims, 2 Drawing Sheets

DUAL TROWEL BLADE ASSEMBLY

This invention pertains to rotary power driven surfacing implements, and more particularly to a trowel blade assembly for use with such implements.

For illustrative purposes the present invention is shown as embodied in a concrete trowelling machine or trowel for operating on the surface of concrete floor installations and the like, such as described in U.S. Pat. Nos. 2,594,331, 2,662,454 and 2,689,507.

BACKGROUND OF THE INVENTION

Although dual trowel blade assemblies, comprising a finish blade attached to a trowel blade, have been disclosed before, as in the aforenoted '507 patent, they do not provide the ultimate in achievable efficiency. Essentially, they fail to recognize that not only must the trowel blade accomplish its assigned task by trowelling on a concrete surface, i.e., by assuming variable tilt angles with respect to such surface, but cooperatively therewith, the attached finish blade should be continuously in contact with the working surface regardless of the tilt angle.

Therefore, a primary object of the present invention is to so arrange the integration of the two types of blades having different characteristics in an assembly such that both tasks noted above can be accomplished, whereby the concrete surface will be constantly smoothed at the same time that it is being worked on by the trowel blade.

An ancillary object is to achieve in a cost-effective and efficient manner the attachment of both types of blades to the trowelling machine, with appropriate positioning of the leading edge of the finish blade relative to the trowel blade to accomplish the stated purposes.

SUMMARY OF THE INVENTION

The above and other objects are fulfilled by the present invention of a dual trowel blade assembly for use with a rotary surfacing machine, the assembly comprising a relatively thick, inflexible trowel blade and a relatively thin, flexible finish blade, wherein the latter is secured in overlapping relationship with respect to the former. When in operation on a substantially horizontal working surface, the finish blade is continuously in contact with the working surface regardless of the variable degrees of tilting of the trowel blade with respect to the working surface as a consequence of oscillating the dual blade assembly about the horizontal.

The above and other objects of the invention are realized by the features of construction hereinafter described in a preferred embodiment as illustrated in the accompanying drawings.

DESCRIPTION OF PREFERRED EMBODIMENT

Figure 1:
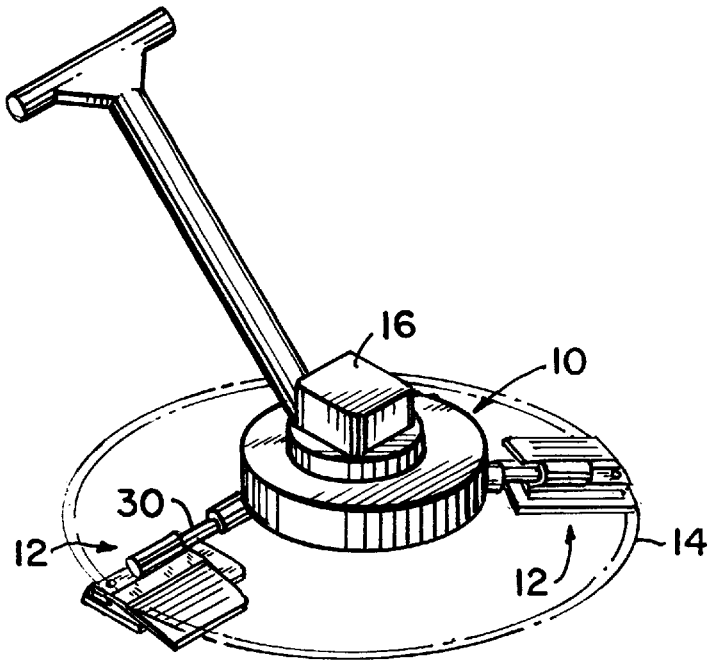
FIG. 1 is a schematic perspective view of a power driven rotary concrete finishing or surfacing machine embodying the present invention.
Figure 2:
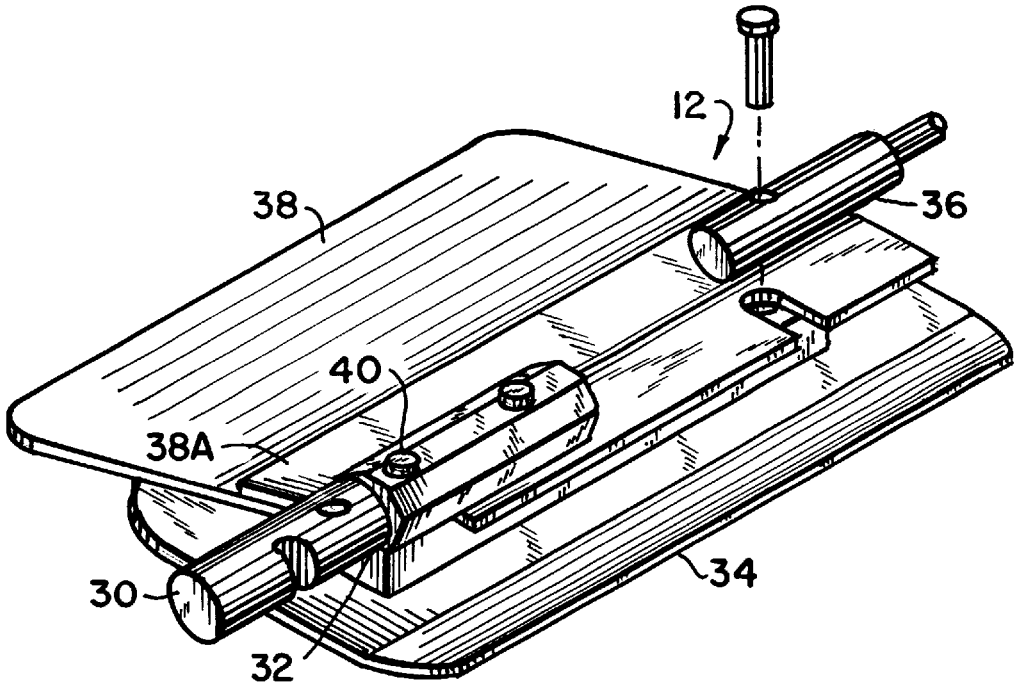
FIG. 2 is a side view of the trowel blade assembly uncoupled from the surfacing machine.

Referring now to FIG. 1, there is shown in perspective view a rotary surfacing machine comprising a rotary base or housing 10 from which radiate a plurality of rotatably adjustable blade assemblies 12. The assemblies 12, each of which includes a trowel blade 34 and a finish blade 38, are surrounded by a guard ring 14 to which the outer ends of the assemblies are pivotally coupled. Located in axial relation above the revolvable base 10 is a driving means 16, such as an electric motor, which is coupled by a gear means (not seen) to the blade assemblies 12 for producing their prescribed rotary motion about a central vertical axis. Manually operated control devices mounted on the handle 18 are connected to the driving means 16. A handle extends upwardly and radially from the housing 16 for guiding the machine over the surface being worked on.

It will be understood that the power transmission and the driving and control features of the rotary surfacing machine seen in FIG. 1 are substantially those of U.S. patent '507 to which reference has been made above. Moreover, details of that construction are incorporated herein by reference, it being understood that a spider device, not shown, but disclosed in patent '507, is provided to enable rotatable adjustment of the blade assemblies 12, whereby tilt angles from the horizontal of as much as 45° for the trowel blades 34 can be realized.

Each of the instant blade assemblies 12 is coupled to the driving means 16 by means of a shaft 30, the shaft being bolted to the radially inner portion of a bar 32, which is affixed, preferably by welding it, to the trowel blade 34 of the blade assembly 12. A stud 36 is bolted to the bar 32, at the radially outer portion thereof, so as to enable a pivot connection of the blade assembly to guard ring 14.

As noted, the blade assembly 12 includes—in addition to a conventional relatively thick and therefore inflexible, trowel blade—a finish blade 38, preferably made of thin, flexible spring steel, about ⅛ inch thick, so as to be capable of being suitably bent to achieve the fundamental objects of the present invention. Accompanying this desirable characteristic is the judicious overlapping mounting of the finish blade 38 with respect to the trowel blade 34, its leading edge being positioned parallel to, and approximately about one half of the distance from, the leading edge of the trowel blade. Referring to the Figures, it will be seen that the leading edge 39 of the finish blade 38 is positioned so as to be clamped between the shaft 30 and the bar 32, when suitable bolts 40 have been run through aligned openings in shaft 30 and bar 32. It will be noted that, for the purpose of preventing excessive flexure and precluding clamping force directly on the finish blade proper, a reinforcing or backing plate 38A is attached at the leading margin of the finish blade 38. To insure that firm support is provided, as well as pivotability, for the blade assemblies the protective ring 14 has openings for receiving the respective ends of studs 36. It will be apparent that stud 36, which is bolted to the bar 32 at the radially outer portion thereof, also enables clamping thereat of the finish blade 38.

Figure 3:
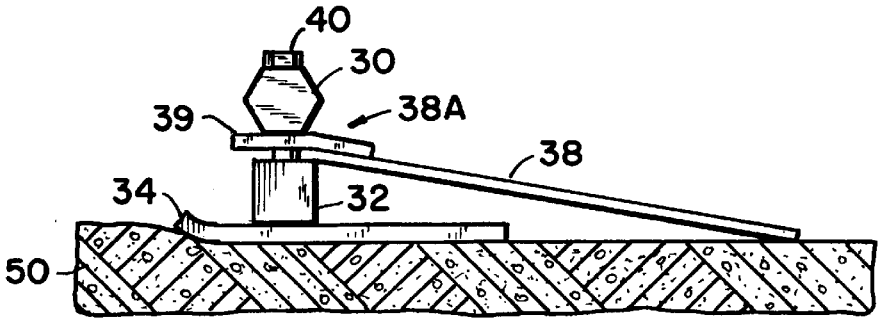
FIGS. 3–5 are diagrammatic views showing various operating positions of the blade assembly, particularly illustrating the finish blade being continuously in contact with the working surface regardless of trowel blade tilt angles.
Figure 4:
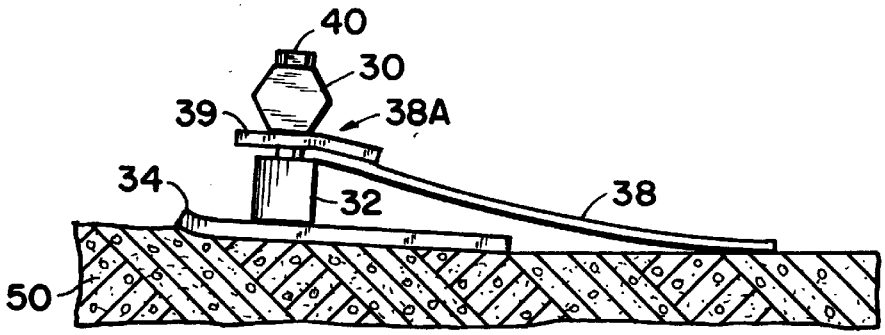
Figure 5:
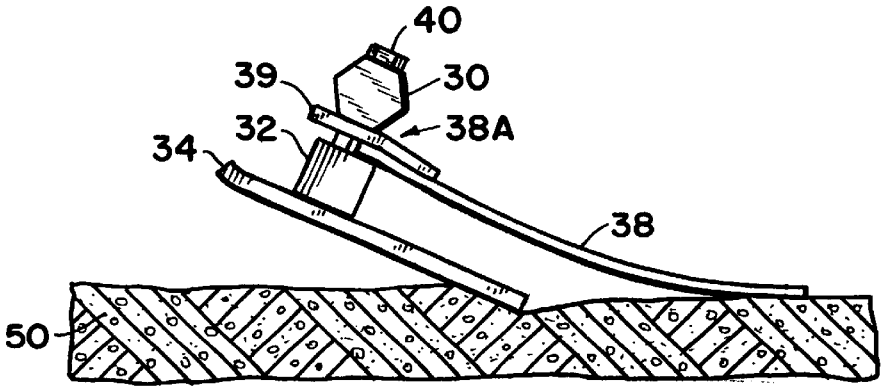

It will be appreciated that as the machine of FIG. 1, equipped with the unique dual blade assemblies described, is used for trowelling the surface 50 of a concrete slab or the like, various oscillating positions of the assembly will be selected by the operator. Referring now especially to FIGS. 3–5 of the drawing, it will be seen that regardless of the consequence of various tilt angles being assumed by the trowel blade 34, the finish blade will always be in contact with the working surface.

The invention having been thus described with particular reference to the preferred forms thereof, it will be obvious that various changes and modifications may be made therein without departing from the spirit and scope of the invention as defined in the appended claims.

What is claimed is:

1. A trowel blade assembly for use with a rotary surfacing machine, said assembly being tiltable with respect to a substantially horizontal working surface; said assembly comprising:

a relatively thick, inflexible trowel bade and a relatively thin, flexible finish blade, each blade having a leading portion and a trailing portion, wherein the finish blade is secured with its leading portion vertically spaced above the leading portion of the trowel blade, the finish blade extending rearwardly and downwardly such that its trailing portion overlaps and extends beyond the trailing portion of the trowel blade so as to be continuously in contact with the working surface when the blade assembly is tilted with respect to the horizontal.

2. A blade assembly as defined in claim 1, in which a reinforcing or backing plate is secured along a longitudinal edge of the finish blade to preclude direct clamping force on the finish blade.

3. A blade assembly as defined in claim 1, in which the blade assembly is securable to a rotary surfacing machine by a shaft forming part of means for rotating the blade assembly.

4. A blade assembly as defined in claim 1, further comprising a bar extending, parallel to and longitudinally adjacent, the leading longitudinal edge of the trowel blade and permanently affixed thereto.

5. A blade assembly as defined in claim 4, in which the bar is positioned on the trowel blade such that the finish blade extends beyond the trailing longitudinal edge of the trowel blade.

6. A blade assembly as defined in claim 5, in which the finish blade is clamped between the shaft and bar and the shaft is fastened to the bar.

7. A rotary surfacing machine comprising:

a plurality of blade assemblies as defined in claim 1;

means for rotating the plurality of blade assemblies together in spaced relation about a vertical axis and for variably oscillating the blade assemblies about the horizontal plane of a working surface into various working positions.

8. A rotary surfacing machine comprising:

a plurality of blade assemblies as defined in claim 2;

means for rotating the plurality of blade assemblies together in spaced relation about a vertical axis and for variably oscillating the blade assemblies about the horizontal plane of a working surface into various working positions.

9. A rotary surfacing machine comprising:

a plurality of blade assemblies as defined in claim 4;

means for rotating the plurality of blade assemblies together in spaced relation about a vertical axis and for variably oscillating the blade assemblies about the horizontal plane of a working surface into various working positions.

10. A rotary surfacing machine comprising:

a plurality of blade assemblies as defined in claim 5;

means for rotating the plurality of blade assemblies together in spaced relation about a vertical axis and for variably oscillating the blade assemblies about the horizontal plane of a working surface into various working positions.

* * * * *